US005103778A

United States Patent [19]

Usich, Jr.

[11] Patent Number: 5,103,778

[45] Date of Patent: Apr. 14, 1992

[54] ROTARY CYLINDER HEAD FOR BARREL TYPE ENGINE

[76] Inventor: Louis N. Usich, Jr., 71 Cheltenham Way, Avon, Conn. 06001

[21] Appl. No.: 523,882

[22] Filed: May 15, 1990

Related U.S. Application Data

[63] Continuation-in-part of Ser. No. 312,676, Feb. 17, 1989, abandoned, which is a continuation-in-part of Ser. No. 202,953, Jun. 6, 1988, abandoned.

[51] Int. Cl.[5] ..... F02B 75/26

[52] U.S. Cl. ..... 123/58 AB; 91/503; 123/43 AA; 123/190 DA

[58] Field of Search ..... 123/43 A, 43 AA, 58 A, 123/58 AA, 58 AB, 58 B, 58 BA, 58 BB, 190 BD, 190 D, 190 E, 190 DA; 91/503

[56] References Cited

U.S. PATENT DOCUMENTS

| | | | |
|---|---|---|---|
| 1,357,600 | 11/1920 | Wade | 123/190 E |
| 1,520,960 | 12/1924 | Nagelmann | 123/58 BA |
| 1,698,102 | 1/1929 | Michell | 123/58 B |
| 2,042,730 | 6/1936 | Redrup | 123/58 BA |
| 2,176,021 | 10/1939 | Grutzner | 60/624 |
| 4,149,498 | 4/1979 | Ferrell | 123/58 AA |

FOREIGN PATENT DOCUMENTS

| | | | |
|---|---|---|---|
| 852974 | 11/1939 | France | 123/58 BA |

*Primary Examiner*—Michael Koczo

*Attorney, Agent, or Firm*—Fishman, Dionne & Cantor

[57] ABSTRACT

Disclosed is a rotating cylinder head for use on a barrel type engine. The cylinder head rotates about the central axis of the engine driven by the main drive shaft. The cylinder head contains an intake port and exhaust port. As the cylinder head rotates, it is timed so that the intake port and the exhaust port become positioned over a pre-selected pair of cylinders which are in respective intake and exhaust cycles. In this manner, the cylinder head functions as a valve assembly. This type of rotary valve is advantageous because it allows the engine to operate at speeds limited only by the piston assembly and not limited by the poppet valve assembly found on more conventional internal combustion engines.

28 Claims, 7 Drawing Sheets

ROTARY CYLINDER HEAD FOR BARREL TYPE ENGINE

CROSS-REFERENCE TO RELATED APPLICATIONS

This is a continuation-in-part of U.S. application Ser. No. 312,676, filed Feb. 17, 1989, abandoned, which is a continuation-in-part of U.S. application Ser. No. 202,953, filed June 6, 1988, abandoned.

BACKGROUND OF THE INVENTION

This invention relates to an internal combustion engine having a rotating cylinder head which functions as a rotary valve. More particularly, this invention relates to a rotary valve for a barrel-type engine.

Heretofore, various types of engines have been known for generating power for use, for example, in propelling automobiles and other motor vehicles. These engines include various types of internal combustion engines which have been constructed with pistons mounted for reciprocation in cylinders. In one particular type of internal combustion engine, the pistons are mounted for reciprocal movement in the cylinders by use of a swash plate. In a swash plate type engine (also known as a barrel-type engine), the swash plate comprises a circular flat or folded disc attached to a drive shaft at an angle of less than 90°. However in many cases these engines have not been highly efficient or quiet in operation and there is a perceived need for an improved swash plate or barrel type engine. An example of a prior art swash plate or barrel engine is shown in U.S. Pat. No. 4,515,113.

SUMMARY OF THE INVENTION

The above-discussed and other problems and deficiencies of the prior art are overcome or alleviated by the barrel type engine of the present invention. In accordance with the present invention, a barrel engine is provided which has increased operating efficiency and which provides a means for adjusting the intake and exhaust valve cycle durations of the engine for operating at high engine speeds or low engine speeds thus enhancing volumetric efficiency. The rotary cylinder head of this invention also provides means for utilizing the kinetic energy of the exhaust stream to improve engine performance and increase engine horsepower output.

The present invention comprises a cylinder head system which rotates at both ends of a barrel type engine and thus functions as a rotary valve. Each cylinder head contains two openings with one opening providing fuel and/or air intake, and the other opening providing exhaust outtake. The two openings are dimensioned such that the minimum width dimension of either opening is equal to the diameter of the cylinder bore. This arrangement provides for improved volumetric efficiencies.

In a preferred embodiment, the fuel and air intake port can have an elliptical surface plate or valve insert acting as a variable intake valve, which mates with the cylinder head. The elliptical plate can be rotated while the engine is operating to widen or lessen the available input area of the valve. This alters the residence time of the valve over the cylinder which optimizes torque output at different engine speeds and loads.

Also in a preferred embodiment, the exhaust opening is provided with an elliptical surface plate acting as a variable exhaust valve containing vanes on its walls to define a turbine. The vanes (e.g. turbine) are used to transfer kinetic energy from the exhaust stream to the cylinder head. This produces additional torque to the rotating cylinder head improving engine efficiency and overall horsepower.

An important feature of the present invention is that, as the cylinder heads rotates, the valve ports (i.e. intake and exhaust openings) sweep over the respective cylinder bores during the respective intake or exhaust stroke. This provides for intake and exhaust without the need for the conventional poppet valve design, thus reducing engine complexity while providing the capability to run the engine at high continuous speeds.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
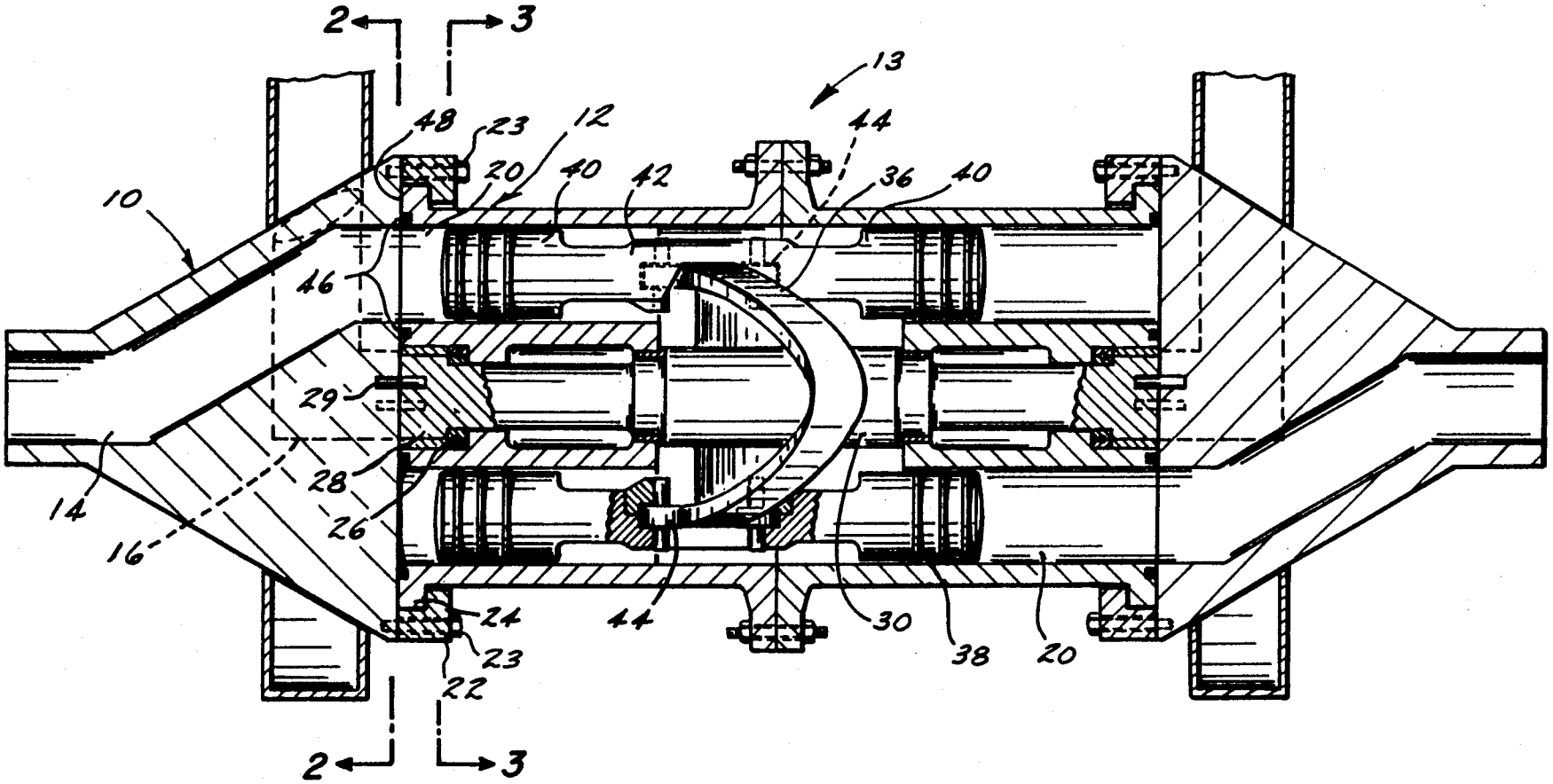
FIG. 1 is a cross-sectional elevation view of a barrel type engine showing rotary cylinder heads in accordance with the present invention.
Figure 3:
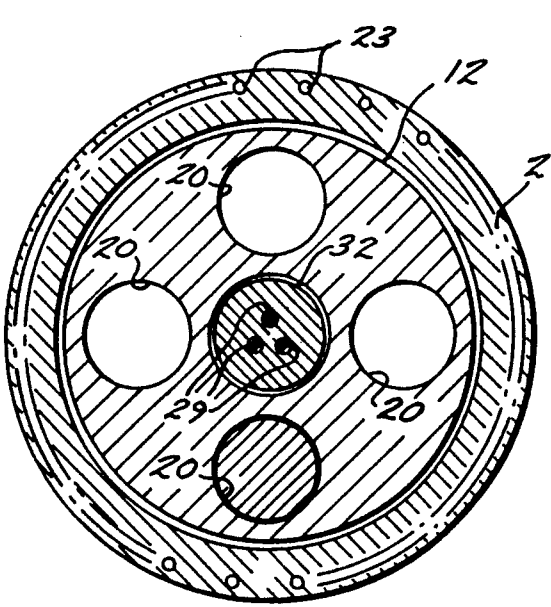
FIG. 3 is a cross-sectional elevation view along the line 3—3 of FIG. 1.
Figure 2:
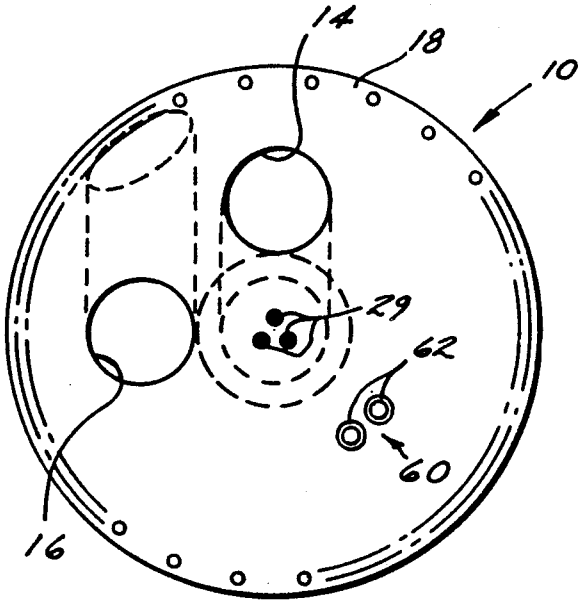
FIG. 2 is a cross-sectional elevation view along the line 2—2 of FIG. 1.

Referring to FIGS. 1-3, the rotating cylinder head of the present invention is shown generally at 10 and is rotatably connected to a cylinder block 12 to define a barrel type engine 13. Cylinder head 10 contains an intake passageway or port 14 and an exhaust passageway or port 16. Both passageways 14 and 16 terminate at a substantially flat cylinder head surface 18. Cylinder head 10 rotates about the central axis of cylinder block 12. The timing of the cylinder head rotation is such that passageways 14 and 16 selectively sweep over the cylinder bores 20 of block 12 in their respective exhaust or intake cycles. In this way, the rotating cylinder heads function as rotary valves. It will be appreciated that there may be two cylinder heads per barrel type engine; but for ease of description, only one cylinder head will be described herein.

The rotating cylinder head 10 is secured to cylinder block 12 by a cylinder head flange 22 extending from the circumference of cylinder head 10 at cylinder head surface 18. Cylinder head flange 22 encases a flange 24 in cylinder block 12 in a concentric fashion. This is achieved by head flange 22 being secured to cylinder head 10 by appropriate fastening means such as threaded fasteners 23 to achieve a close fit around cylinder block flange 24.

Cylinder head 10 is also secured to cylinder block 12 by a central support bearing 26. Bearing 26 is positioned between cylinder block 10 and a flanged journal head 28 which is formed as an integral part of a main drive shaft 30. An opening 32 (which also receives bearing 26) is centrally located in block 12 and receives flanged journal head 28. Main shaft 30 is connected to the cylinder head by fasteners 29 accessed through cylinder head 10. Central support bearing 26 surrounds and entraps flanged journal head 28 securing cylinder head 10 to cylinder block 12.

Cylinder head 10 is connected t and rotated by main drive shaft 30. Energy is imparted to the main drive shaft 30 through a cam 36. Cam 36 interconnects main drive shaft 30 and a piston assembly 38. Cam 36 comprises a folded circular disc, and is attached to main drive shaft 30 at a predetermined angle wherein the distance between the vertical and the outer edge of the top most section of cam 36 equals half of a full piston stroke.

Cam 36 is attached to a piston assembly 38. Piston assembly 38 is comprised of two piston heads 40 and an arm 42 which interconnects the two piston heads 40. Arm 42 is connected to cam 36 by a key assembly 44. Pistons 40 are cylindrical and have a diameter equivalent to the diameter of cylindrical bores 20. Pistons 40 travel back and forth along the length of the cylinder bores 20. The preferred embodiment of this invention includes four piston assemblies or eight pistons. This number represents what is typically referred to as an eight cylinder engine.

It will be appreciated the cylinder head 10 is in close fit with cylinder block 12 and is free to rotate at a minimum of working clearance. A plurality of cylindrical seals 46 are found on the cylinder block face 48. Seals 46 encircle the cylinder entrance 50 and seal the gap formed between cylinder block face 48 and cylinder head surface 18. It will be appreciated that seals 46 will prevent blowby.

Figure 4:
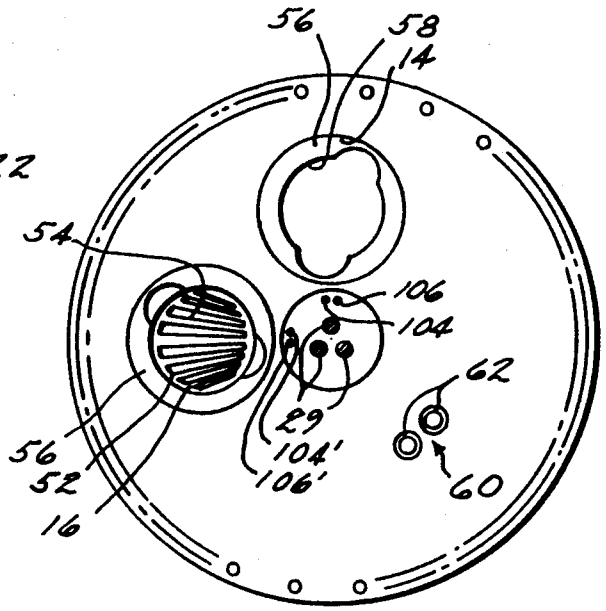
FIG. 4 is a cross-sectional elevation view, similar to FIG. 2.

Preferably, intake valve passageway 14 and exhaust valve passageway 16 are cylindrical and have diameters equal to the diameter of cylinder 20. As shown in FIG. 4, the exhaust valve passageway 16 may contain a turbine 52 which has appropriately shaped vanes 54 which transfer the force of the exiting exhaust stream to the rotating cylinder head providing increased torque.

Figure 5:
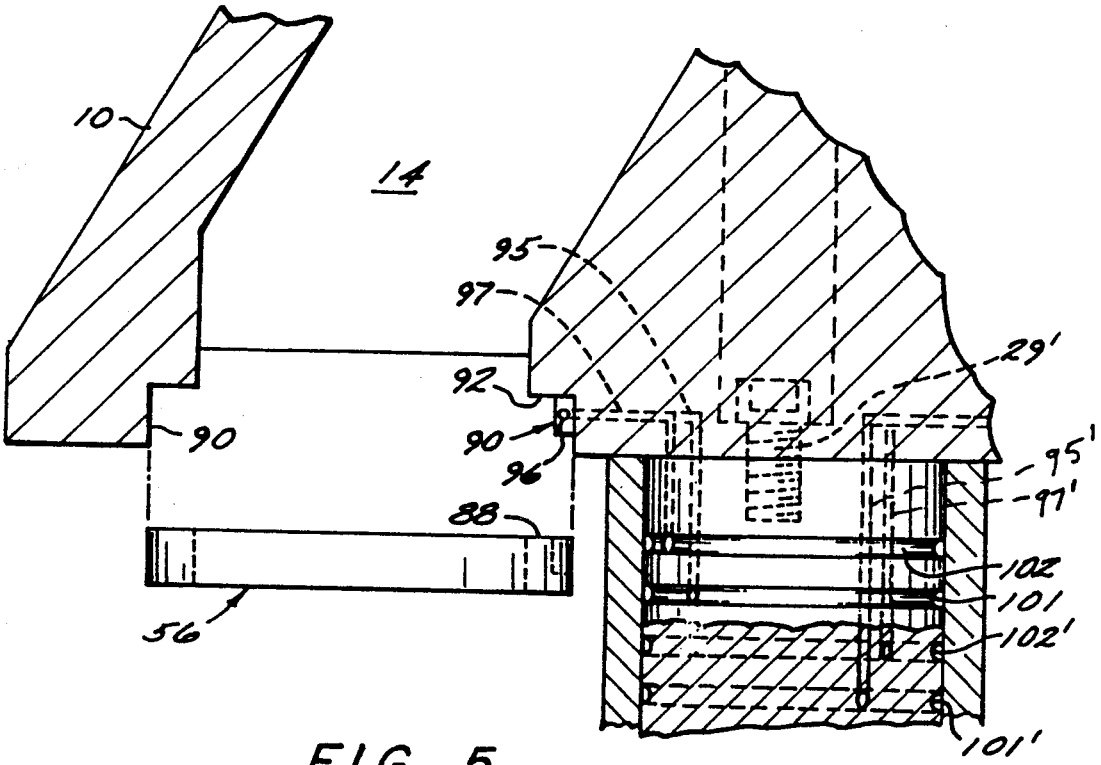
FIG. 5 is a cross-sectional elevation view depicting a valve insert being loaded into an intake valve of the engine of FIG. 1.
Figure 6:
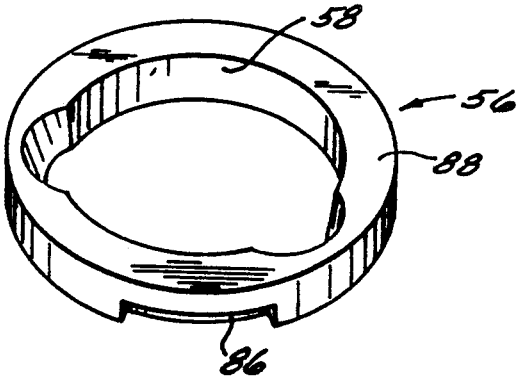
FIG. 6 is a front perspective view of a valve insert in accordance with the present invention.
Figure 7:
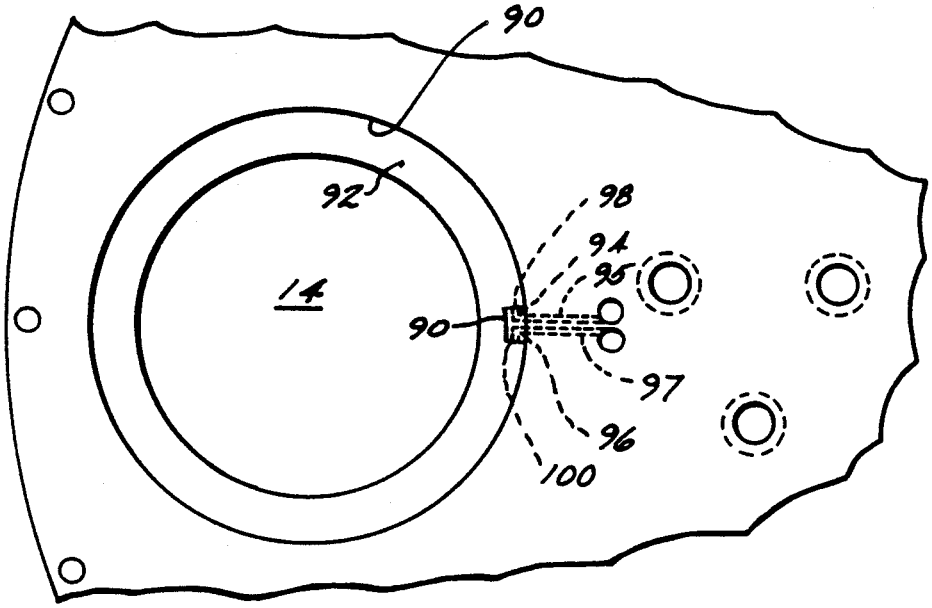
FIG. 7 is a top plan view of a portion of a rotary cylinder head in accordance with the present invention with the valve insert having been removed.
Figure 8:
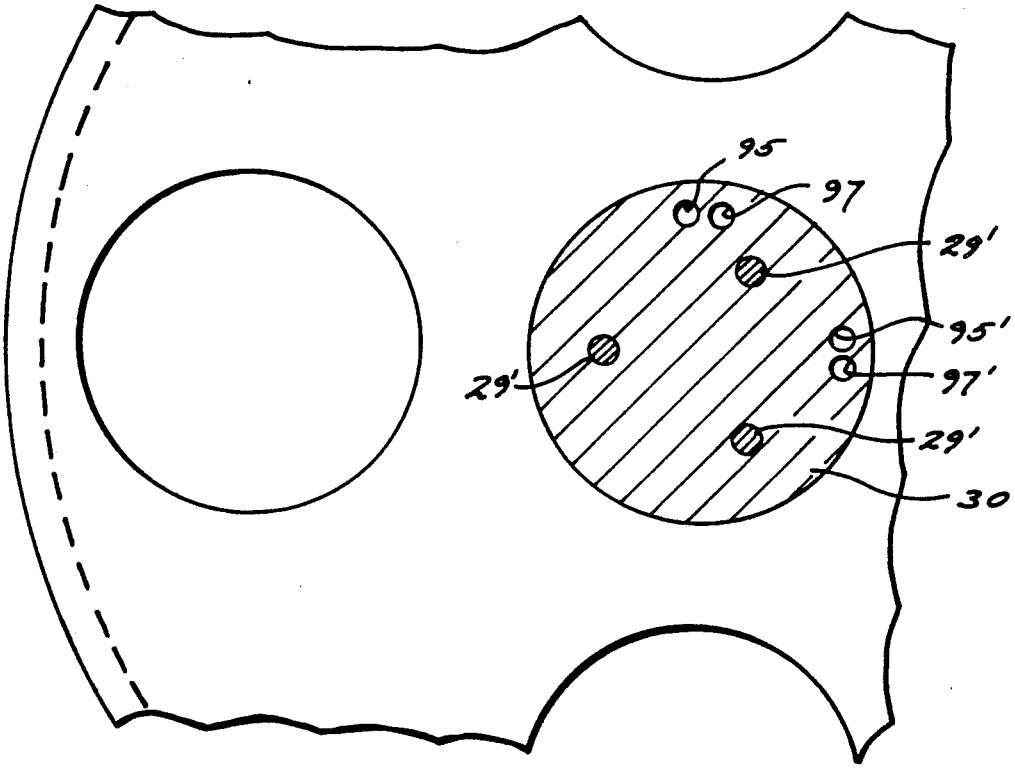
FIG. 8 is a top plan view of a portion of the engine of FIG. 1 depicting cylinder bores and the main shaft.

Referring now to FIGS. 4–7, preferably, both valve passageways 14 and 16 have respective circular intake and exhaust valve inserts 56 found on the cylinder head surface 18. Each insert 56 has an oblong, quasi-eliptical or elongated opening 58, with a minimum width dimension equal to the diameter of cylinder 20 and a length dimension greater than the diameter of cylinder 20. As shown in FIGS. 5 and 6, insert 56 includes a radial groove or cutout 86 which extends inwardly from bottom surface 88 of insert 56. Insert 56 is received in a valve insert bore 90 of intake port 14 (and an insert 56' is received in valve opening 16). As best shown in FIGS. 5 and 7, a small metering block 90 of rectangular configuration extends upwardly from the annular shelf 92 defined by valve insert bore 90. Metering block 90 includes a pair of oppositely disposed interior bores 94 and 96 which terminate at openings disposed on the sides 98 and 100 of block 90. Each hole 94 and 96 has a right angle turn which communicates with a respective passageway 95 and 97 in cylinder head 10 terminating at a respective oil gallery groove 101, 102 (see FIGS. 5 and 9). In turn, a pair of actuator oil supply passages 104 and 106 (see FIG. 9) in cylinder block 12 communicate with each respective oil gallery groove 101, 102 so as to supply oil to insert 56 in the valve opening 14. Leakage of oil from grooves 101, 102, 101' and 102' is prevented by use of a seal tight fit bushing 140. It will be appreciated that a pair of actuator oil supply passages 104' and 106' (see FIG. 9) provide oil to oil grooves 101', 102' and thence to oil supply passages 104', 106', for an insert 56 in valve opening 16.

Figure 9:
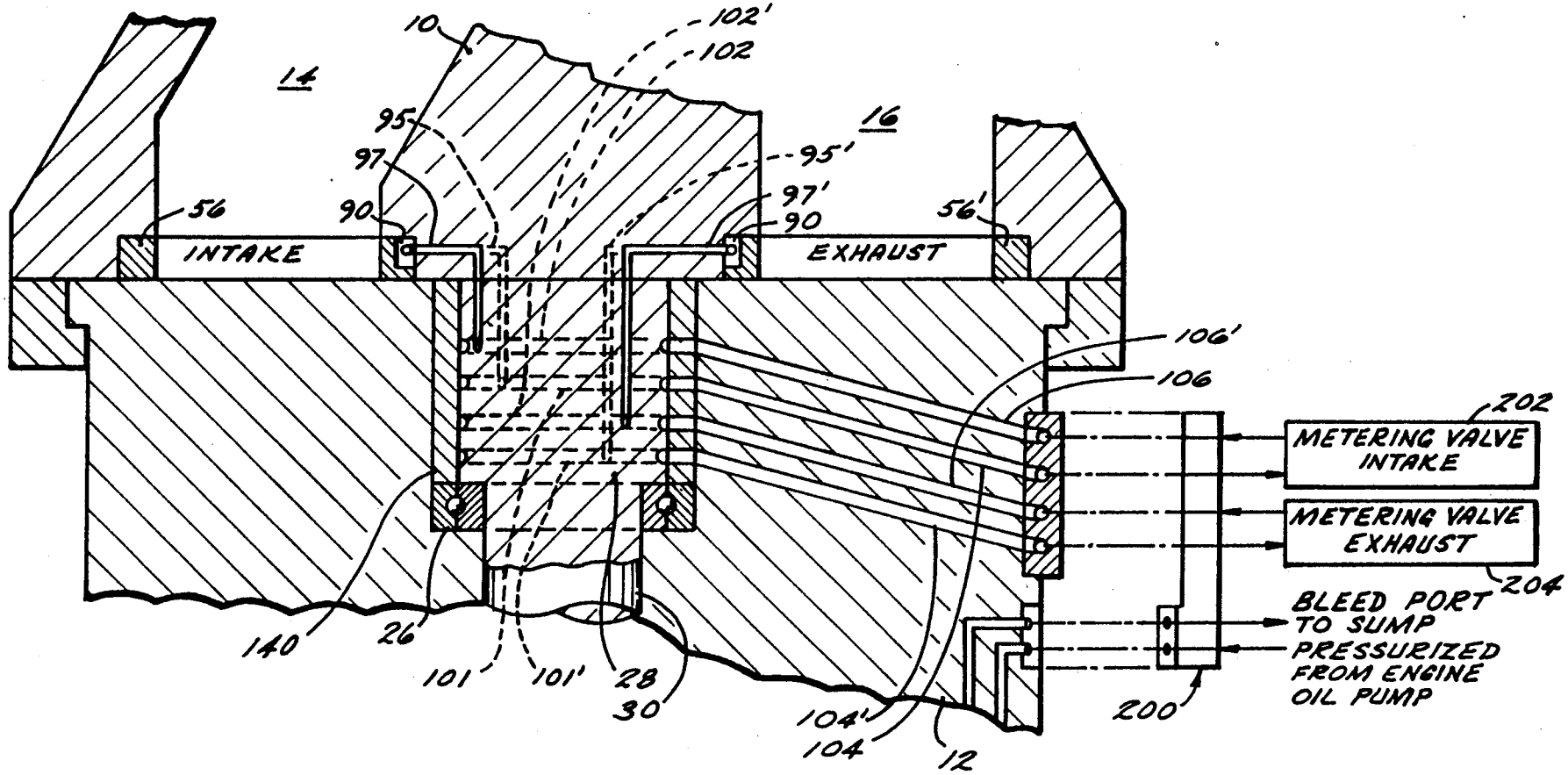
FIG. 9 is a cross sectional elevation view through a longitudinal portion of the rotary cylinder head of the present invention.

Insert 56 (or 56') is assembled within a valve opening 14 (or 16) by aligning radial cutout 86 with metering block 90 as shown in FIG. 5 to form a pair of pressure chambers identified at 108 and 110 in FIG. 9. It will be appreciated that pressure chambers 108, 110 are defined by the metering block 90 dividing the space defined by radial cutout 86. It will be appreciated further that the radial cutout 86 machined in the circumference of valve insert 56 must be in close fit or tolerance with the metering block 90 in cylinder head insert valve recess 92 to avoid leakage. Metering block 90 has two important functions including a means for supplying or metering oil into one or the other of chambers 108 and 110; and also for acting as a stop to preclude further rotation of valve insert 56 in recess 92.

Thus, the above described mechanism permits the valve inserts 56, 56' can be rotated in valve openings 14 and 16. This is accomplished by metering engine oil (through passages 104, 106 or 104', 106' and the associated galleries) into one or the other of the two pressure chambers 108, 110 formed by the radial cutout 86 and metering block 90. The metering block 90 will supply pressurized oil to one respective cavity 108 or 110 at a time thereby advancing or retarding insert 56 (56') and forcing the valve insert to rotate until it hits the metering block 90 (which, as mentioned, also acts as a stop). It will be appreciated that when the metering valve 90 commands pressure to one side of the respective pressure cavity 108 or 110, the non-pressurized cavity will be allowed to empty or reduce the oil it contains through the metering block 90. As shown in FIG. 9, a conventional hydraulic circuit 200 that is controlled by pressurized oil from a pair of two way valves 202, 204 may be used to meter oil to either side of the pressurized cavity defined by chambers 108, 110. The two way valves are mounted externally and send oil into the engine along respective passageways 104, 106 (or 104', 106') in the engine block 12. Each respective passageway 104, 106, 104', 106' mates with a respective groove 101, 102, 101', 102' in the crankshaft journal 28 with the cylinder head ultimately bringing control oil through passageways 95, 97 (95', 97') and to the metering block 90 to rotate valve insert 56 to full advance, full retard or an infinite number of positions in between as directed by the metering valve.

It will be appreciated that FIG. 9 has been shown for illustration purposes only and for ease of understanding. Since the valve openings 14 and 16 are actualy 90° apart (rather than 180° as shown in FIG. 9).

Figure 10:
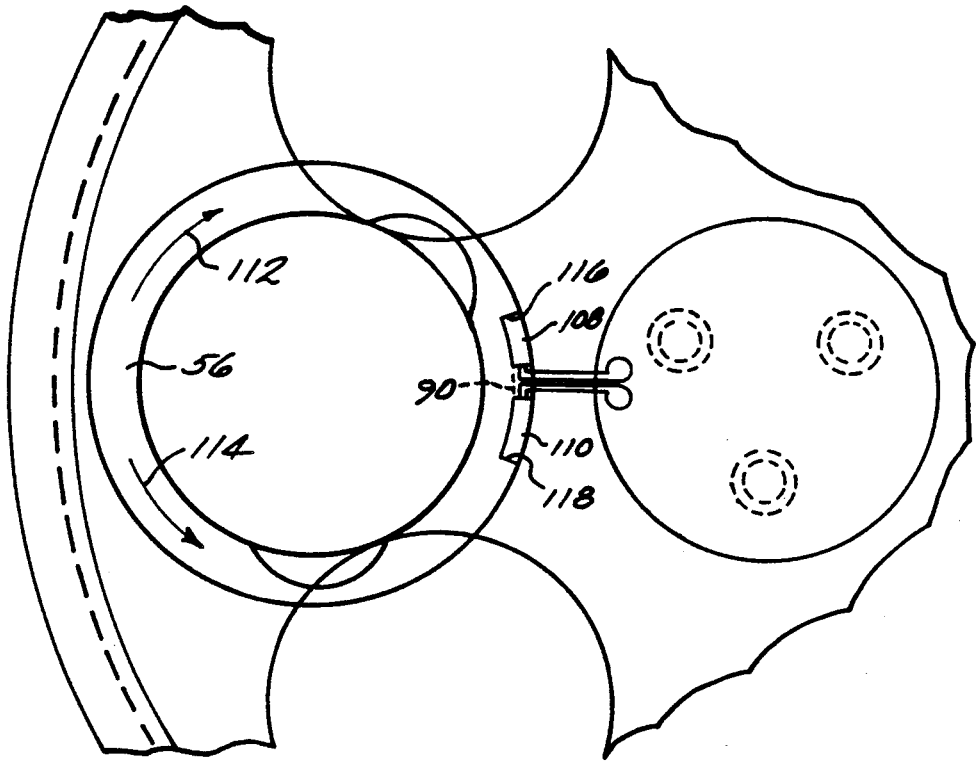
FIG. 10 is a cross-sectional elevation view of the rotary cylinder head of FIG. 4 depicting rotation scenarios for the valve insert.

Turning now to FIG. 10, it will be appreciated that valve insert 56 will rotate clockwise (see arrow 112) when pressurized oil will pass through metering block 90 into pressurized cavity 110 while simultaneously oil in cavity 108 will be bled from cavity 108 and out through metering block 90. In this scenario, valve insert 56 will be retarded by the pressurized engine oil from the control mechanism. Conversely, valve insert 56 will be advanced by the pressurized oil and rotate counterclock wise in the direction indicated by arrow 114 when oil is introduced into metering block 90 and chamber 108 and simultaneously pressurized oil is bled from chamber 110. It will be appreciated that rotation of the valve in either a clockwise (retard) or counterclock wise (advance) rotation will be affected by the pressurized oil exerting pressure against the cavity (108 or 110) end wall thereby rotating the insert.

Figure 11:
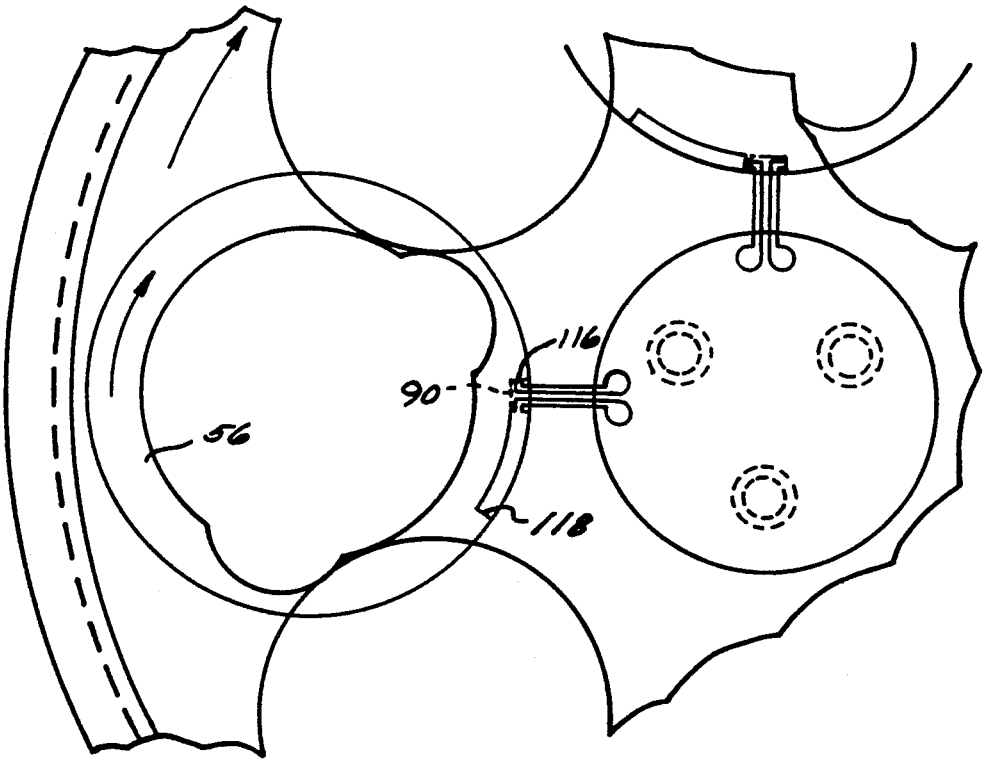
FIG. 11 is a cross-sectional elevation view similar to FIG. 10 showing the valve insert in a fully retarded position.

Turning now to FIG. 11, valve insert 56 is shown in a full retard position wherein oil has been fed into chamber 110 until metering block 90 has engaged the end wall 116 of chamber 108 and thereby acted as a stop to preclude further rotation of valve insert 56. It will be appreciated that metering block 90 will act in a similar manner when insert 56 is rotated in a counterclock wise direction so that metering block 90 will eventually contact the side wall 118 of chamber 110 and act as a stop in further rotation thereby positioning valve insert 56 in a full advance mode.

Note that rather than using the dowels 29 of FIG. 1, FIG. 5 shows an alternative embodiment using threaded bolts 29'.

The centers of exhaust valve opening 16 and intake valve opening 14 are located at about the same distance from the center of cylinder head 10. The radii extending from the center of cylinder head face 18 through the centers of valve openings 14 and 16 are opposed at a 90° angle.

Preferably, an igniting system 60 is located on the cylinder head surface, at about the same distance off center as the valve openings 14 and 16. The ignitors can be a diesel glow plug, a spark plug or any other known means for igniting fuel.

It will be appreciated that the present invention contemplates the utilization of other elements which are commonly found in engines of this type. However, for reasons of clarity and simplicity, these other elements which include a lubrication system, a cooling system, a power takeoff, a starter, and any other elements commonly associated with an internal combustion engine are not shown in the drawings.

The operation of the barrel engine of the present invention will now be described. When a cylinder fires, piston 40 moves linearly carrying cam 36 therewith. Cam 36 rotates, causing the main drive shaft 30 to spin. Energy is then transferred from the main drive shaft 30 to the flanged journal head 28 which is attached to the cylinder head 10, causing the cylinder head to rotate at mainshaft speed.

As the cylinder head 10 rotates, the exhaust valve opening 16 sweeps over the cylinder in its exhaust cycle, and the intake valve opening 14 sweeps over another cylinder in the intake cycle. It will be appreciated that for every 90°, the main shaft 30 rotates, the cylinder head also rotates 90°.

The complete cycle of a single cylinder will now be described to explain how the rotary valve cylinder head of the present invention operates.

As the main shaft 30 rotates from 0° to 90°, piston 40 moves from bottom dead center (BDC) to top dead center (TDC) representing the exhaust cycle.

When mainshaft 30 is located at 0°, the exhaust valve opening edge (in its retarded position) mates exactly with the cylinder bore leading edge (FIG. 5). This will be 0° for the cylinder head.

When the mainshaft moves to the 90° position (BDC to TDC exhaust cycle) the exhaust valve will sweep the entire cylinder bore mating exhaust valve opening edge exactly at cylinder bore trailing edge (this is 90° for the cylinder head) and completes the exhaust cycle.

Co-incidently, at 90° mainshaft rotation (TDC) and 90° cylinder head rotation, the intake valve opening edge mates exactly with the cylinder bore leading edge, beginning the intake cycle.

At 180° the mainshaft completes the intake cycle (BDC) and brings cylinder head intake opening edge into exact register with the trailing edge of the cylinder bore completing intake cycle and initiating compression stroke.

The mainshaft then rotates to 270° thus bringing the piston to TDC thereby completing compression while bringing the ignitor system into registration with the cylinder bore as the cylinder head is at its 270° position, initiating the power cycle.

The mainshaft then rotates to 360° (BDC) thus completing the power stroke and also returning the cylinder head to its 360° position, returning exhaust valve opening to its original position (360°=0°—one full revolution) at exact edge of cylinder bore (BDC) beginning the four cycle event once again.

It can be seen that four piston cycles occur for every mainshaft revolution; also that cylinder head moves the same rotational speed as the mainshaft providing exact valve timing.

Figure 13:
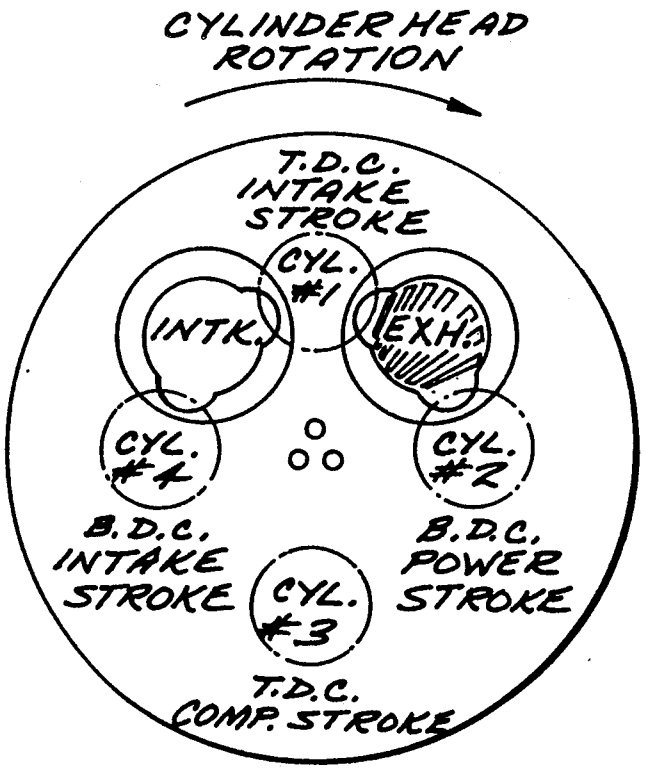
FIGS. 12 and 13 are cross-sectional elevation views of the rotary cylinder head of FIG. 4 depicting cylinder head rotation configurations.

It will be appreciated that the elongation of the valve openings (via valve inserts 56) 14 and 16 is an important feature of the present invention as this will increase the residence time of the valve opening over each cylinder. By rotating intake and exhaust valve inserts 56 until the length dimension of the oblong opening 58 is perpendicular to the radius of the cylinder head face 18, an increase in residence time will result (FIG. 13). This improves intake and exhaust efficiencies at high engine speeds. At low engine speeds, valve insert 56 can be rotated until the length of the oblong opening 58 is aligned with the radius of the cylinder head face 18. This rotation minimizes the valve residence time enhancing engine efficiency at low speeds.

Figure 12:
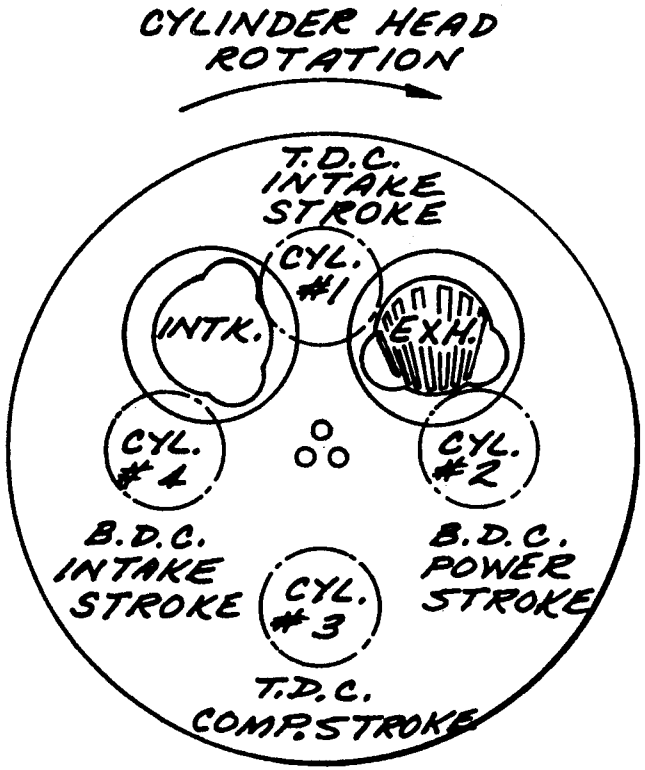

The operation of inserts 56 is more fully described by reference to FIGS. 12 and 13. In FIG. 12, the metered engine oil has ordered the valve inserts 56 to spin to a full retard position so that:

(1) The intake valve opening is exactly tangential to cylinder Nos. 1 and 4;

(2) the exhaust valve opening is exactly tangential to cylinder Nos. 1 and 2;

(3) both intake and exhaust valves have completed perfect respective intake and exhaust events;

(4) both valves are initiating perfect intake and exhaust events.

In FIG. 13, the metered engine oil has ordered the valve inserts 56 to spin to a full advance position so that:

(1) The intake valve is rotated to a full advance at cylinder Nos. 1 and 4 to bring both cylinders into a valve overlap condition;

(2) the exhaust valve is rotated to a full advance at cylinder Nos. 1 and 2 to bring both cylinders into a valve overlap position.

Of course, valve inserts 56 may be rotated to take on positioning anywhere between that shown in FIGS. 12 and 13. This rotation may be actuated by microprocessor controlled means to control respective intake and exhaust valve insert oil metering, thereby altering valve event timing.

While the cam engine 13 is the preferred embodiment of the present invention, other engines and driveshaft configurations can be used to rotate the cylinder head. Also the engine may be configured in a manner in which the main drive shaft is not centrally located. In this configuration, the main drive shaft would be offset from the cylinder chambers. In this latter embodiment, the drive shaft would drive the cylinder head externally by means of a gear arrangement on the outer housing of the cylinder head or some other means, including but not limited to, timing belts or chains.

While preferred embodiments have been shown and described, various modifications and substitutions may be made thereto without departing from the spirit and scope of the invention. Accordingly it is to be understood that the present invention has been described by way of illustration and not limitations.

What is claimed is:

1. An engine comprising:

an engine block having four parallel cylinder chambers;

a piston slidably mounted in each of said chambers to define four compression chambers;

rotary cylinder head means rotatably attached to said engine block, said cylinder head means including an exhaust duct and an intake duct;

valve insert means in at least one of said intake and exhaust ducts, said valve insert means having an opening with a geometry which is different from the geometries of said intake and exhaust ducts, said valve insert means rotating within one of said intake and exhaust ducts to change the orientation of said valve insert means opening with respect to said intake and exhaust ducts; and transmission means for reciprocating said pistons within said cylinder chambers in synchronization to the rotation of said cylinder head means on said engine block wherein said rotating cylinder head means selectively communicates with said exhaust duct and one of said compression chambers in an exhaust cycle, and with said intake duct and one of said compression chambers in an intake cycle.

2. The engine of claim 1 further including a shaft rotatably mounted along a longitudinal axis of said cylinder block and wherein said transmission means comprises:

first rotating means mounted on said shaft for reciprocating said piston; and second rotating means connected to said shaft for rotating said cylinder head means.

3. The engine of claim 2, wherein:

said first rotating means comprises a cam mounted on said shaft.

4. The engine of claim 1 wherein:

said exhaust duct includes turbine means to transfer exhaust stream energy to cylinder head means rotational energy.

5. The engine of claim 1 wherein:

said valve insert means includes turbine means to transfer exhaust stream energy to cylinder head means rotational energy.

6. The engine of claim 1 wherein:

said valve insert means opening comprises an oblong opening.

7. The engine of claim 1 wherein said valve insert means has an exterior surface and further including:

a radial groove on said exterior surface of said valve insert means;

metering block means in said intake and exhaust ducts, said metering block means communicating with said radial groove to define a pair of first and second cavities, a first opening through said metering block means for supplying oil to said first cavity and a second opening through said metering block means for supplying oil to said second cavity;

a first oil passage for metering oil to said first opening; and a second oil passage for metering oil to said second opening.

8. The engine of claim 1 including:

limiting means for limiting the rotation of said valve insert means.

9. The engine of claim 1 wherein:

said valve insert means opening has a minimum width dimension equal to the diameter of one of said four cylinder chambers; and said valve insert means opening has a length dimension greater than the diameter of one of said four cylinder chambers.

10. The engine of claim 1 including:

valve insert means in both of said intake and exhaust ducts.

11. The engine of claim 1 including:

ignition means in said cylinder head means for igniting a fuel mixture.

12. The engine of claim 7 including:

metering valve means for selectively metering oil to said first or second opening and for selectively bleeding oil from said first or second passage.

13. The engine of claim 7 wherein said first and second passage each further includes:

a circumferential groove on a drive shaft of said transmission means;

a first conduit in said rotary cylinder head means between said metering block means and said circumferential groove; and a second conduit in said engine block extending from said circumferential groove.

14. The engine of claim 13 including:

metering valve means communicating with said second conduit for selectively metering oil to said first or second opening and for selectively bleeding oil from said first or second conduit.

15. An engine comprising:

an engine block having at least one cylinder chamber;

a piston slidably mounted in said chamber to define a compression chamber;

rotary cylinder head means rotatably attached to said engine block, said cylinder head means including an exhaust duct and an intake duct;

valve insert means in at least one of said intake and exhaust ducts, said valve insert means having an opening with a geometry which is different from the geometries of said intake and exhaust ducts, said valve insert means rotating within one of said intake and exhaust ducts to change the orientation of said valve insert means opening with respect to said intake and exhaust ducts; and transmission means for reciprocating said piston within said cylinder chamber in synchronization to the rotation of said cylinder head means on said engine block wherein said rotating cylinder head means selectively communicates with said exhaust duct and said compression chamber in an exhaust cycle, and with said intake duct and said compression chamber in an intake cycle.

16. The engine of claim 15 further including a shaft rotatably mounted along a longitudinal axis of said cylinder block and wherein said transmission means comprises:

first rotating means mounted on said shaft for rotating said piston; and second rotating means connected to said shaft for rotating said cylinder head means.

17. The engine of claim 16 wherein:

said first rotating means comprises a cam mounted on said shaft.

18. The engine of claim 15 wherein:

said exhaust duct includes turbine means to transfer exhaust stream energy to cylinder head means rotational energy.

19. The engine of claim 15 wherein:

said valve insert means includes turbine means to transfer exhaust stream energy to cylinder head means rotational energy.

20. The engine of claim 15 wherein:

said valve insert means opening comprises an oblong opening.

21. The engine of claim 15 wherein said valve insert means has an exterior surface and further including:

a radial groove on said exterior surface of said valve insert means;

metering block means in said intake and exhaust ducts, said metering block means communicating with said radial groove to define a pair of first and second cavities, a first opening through said metering block means for supplying oil to said first cavity and a second opening through said metering block means for supplying oil to said second cavity;

a first oil passage for metering oil to said first opening; and a second oil passage for metering oil to said second opening.

22. The engine of claim 15 including:

limiting means for limiting the rotation of said valve insert means.

23. The engine of claim 15 wherein:

said valve insert means opening has a minimum width dimension equal to the diameter of one of said four cylinder chambers; and said valve insert means opening has a length dimension greater than the diameter of one of said four cylinder chambers.

24. The engine of claim 15 including:

valve insert means in both of said intake and exhaust ducts.

25. The engine of claim 15 including:

ignition means in said cylinder head means for igniting a fuel mixture.

26. The engine of claim 21 including:

metering valve means for selectively metering oil to said first or second opening and for selectively bleeding oil from said first or second passage.

27. The engine of claim 21 wherein said first and second passage each further includes:

a circumferential groove on a drive shaft of said transmission means;

a first conduit in said rotary cylinder head means between said metering block means and said circumferential groove; and a second conduit in said engine block extending from said circumferential groove.

28. The engine of claim 27 including:

metering valve means communicating with said second conduit for selectively metering oil to said first or second opening and for selectively bleeding oil from said first or second conduit.

* * * * *